US010753039B2

(12) United States Patent
Michael et al.

(10) Patent No.: US 10,753,039 B2
(45) Date of Patent: Aug. 25, 2020

(54) CONTINUOUS LINEAR SUBSTRATE INFUSION

(71) Applicant: RADCO INFUSION TECHNOLOGIES, LLC, Toledo, OH (US)

(72) Inventors: Douglas Michael, Swanton, OH (US); Richard Yorde, Maumee, OH (US); Rick Anderson, Waterville, OH (US)

(73) Assignee: Radco Infusion Technologies, LLC, Toledo, OH (US)

( * ) Notice: Subject to any disclaimer, the term of this patent is extended or adjusted under 35 U.S.C. 154(b) by 0 days.

(21) Appl. No.: 16/098,943

(22) PCT Filed: May 5, 2017

(86) PCT No.: PCT/US2017/031354
§ 371 (c)(1),
(2) Date: Nov. 5, 2018

(87) PCT Pub. No.: WO2017/193031
PCT Pub. Date: Nov. 9, 2017

(65) Prior Publication Data

US 2019/0093281 A1 Mar. 28, 2019

Related U.S. Application Data

(60) Provisional application No. 62/332,787, filed on May 6, 2016.

(51) Int. Cl.
*D06B 3/00* (2006.01)
*D06P 3/24* (2006.01)
(Continued)

(52) U.S. Cl.
CPC ..... *D06P 3/241* (2013.01); *D06B 3/02* (2013.01); *D06B 5/02* (2013.01); *D06B 23/22* (2013.01); *D06B 3/00* (2013.01); *D10B 2331/02* (2013.01)

(58) Field of Classification Search
CPC ..... D06B 3/00; D06B 2700/28; D06B 27/09; D06B 3/02; D06B 19/0035; D06B 23/22; D06B 5/02; D06B 13/00; D06B 2331/02
See application file for complete search history.

(56) References Cited

U.S. PATENT DOCUMENTS 2,986,116 A 5/1961 Zerwes
3,544,388 A 12/1970 Russell
(Continued)

FOREIGN PATENT DOCUMENTS

CN 102856007 A 1/2013
CN 102856007 B 9/2014
(Continued)

*Primary Examiner* — Eisa B Elhilo
(74) *Attorney, Agent, or Firm* — Dinsmore & Shohl LLP; Weston R. Gould

(57) ABSTRACT

A method of forming an active agent infused linear material includes passing a substantially linear polymeric substrate through a linear substrate infusion chamber in a first direction, flowing a liquid infusion solution through the linear substrate infusion chamber in a second direction, and contacting the linear substrate with the liquid infusion solution at an infusion temperature and for an infusion time effective to infuse the one or more active molecules into or onto a surface of the linear substrate, thereby forming an active agent infused linear material. The liquid infusion solution includes one or more active molecules. The second direction is substantially opposite or substantially parallel to the first direction. A linear substrate infusion system and a polymeric linear substrate are also disclosed.

11 Claims, 5 Drawing Sheets

(51) Int. Cl.

| | |
|---|---|
| ***D06B 5/02*** | (2006.01) |
| ***D06B 23/22*** | (2006.01) |
| ***D06B 3/02*** | (2006.01) |

(56) References Cited

U.S. PATENT DOCUMENTS

| | | | | |
|---|---|---|---|---|
| 4,371,371 | A | 2/1983 | Smrekar | |
| 4,505,222 | A | 3/1985 | Holt et al. | |
| 4,592,107 | A | 6/1986 | von der Eltz | |
| 4,825,491 | A | 5/1989 | Miyamoto et al. | |
| 6,044,509 | A * | 4/2000 | Schrell ..... | D06B 3/28 8/152 |
| 6,652,654 | B1 | 11/2003 | Propp et al. | |
| 8,286,578 | B2 | 10/2012 | Leenders et al. | |
| 2003/0124253 | A1 | 7/2003 | Kamata et al. | |
| 2006/0038356 | A1 | 2/2006 | Lehtinen | |

FOREIGN PATENT DOCUMENTS

| | | | |
|---|---|---|---|
| EP | 0068775 | A1 | 1/1983 |
| WO | 2009011182 | A1 | 1/2009 |
| WO | 2016038335 | A1 | 3/2016 |

* cited by examiner

CONTINUOUS LINEAR SUBSTRATE INFUSION

CROSS-REFERENCE TO RELATED APPLICATIONS

This application depends from and claims priority to U.S. Provisional Application No. 62/332,787 filed May 6, 2016, the entire contents of which is incorporated herein by reference.

TECHNICAL FIELD

The present specification generally relates to imparting desirable characteristics to linear substrates such as polymeric substrates. The specification provides improved devices and methods for adding active agents that impart such characteristics to a linear substrate.

BACKGROUND

The inclusion of desirable characteristics to polymeric substrates has historically required a physical association of chemical materials to the substrate during the manufacturing process itself. For example, imparting color to a polymer is historically done by intermixing or compounding pigment or dye particles into a melted polymer either before polymerization or before forming into the final desired shape so that the dye particles can penetrate throughout the material and impart color to the final product.

Such methods have several drawbacks such as the dye particle is subjected to one or more melt/cool cycles during the manufacture of the final article which could result in degradation of the dye and alterations of color relative to that desired. A first heat step is present when the dye is incorporated into the melted polymeric material itself, and a second occurs when the article is formed into the final article shape such as by extrusion or other thermoforming.

Other prior methods of imparting desirable physical or chemical characteristics to polymeric substrates such as color or weathering rely on coating of the final article such as by painting color or other materials onto the surface of the article. Such configurations are subject to degradation such as by cracking, peeling, chipping or other that removes all or a portion of the coated material and reveals weaknesses on the overall article. Further, coatings must have sufficient flexibility to maintain integrity on a flexible substrate and such flexibility is difficult to achieve.

As such, there is a desire to develop new methods and systems for imparting desirable physical or chemical characteristics to polymeric substrates such as linear polymeric substrates.

BRIEF DESCRIPTION OF THE DRAWINGS

The aspects set forth in the drawings are illustrative and exemplary in nature and not intended to limit the subject matter defined by the description and claims. The following detailed description of the illustrative aspects can be understood when read in conjunction with the following drawings, where like structure is indicated with like reference numerals and in which:

SUMMARY

Figure 1A:
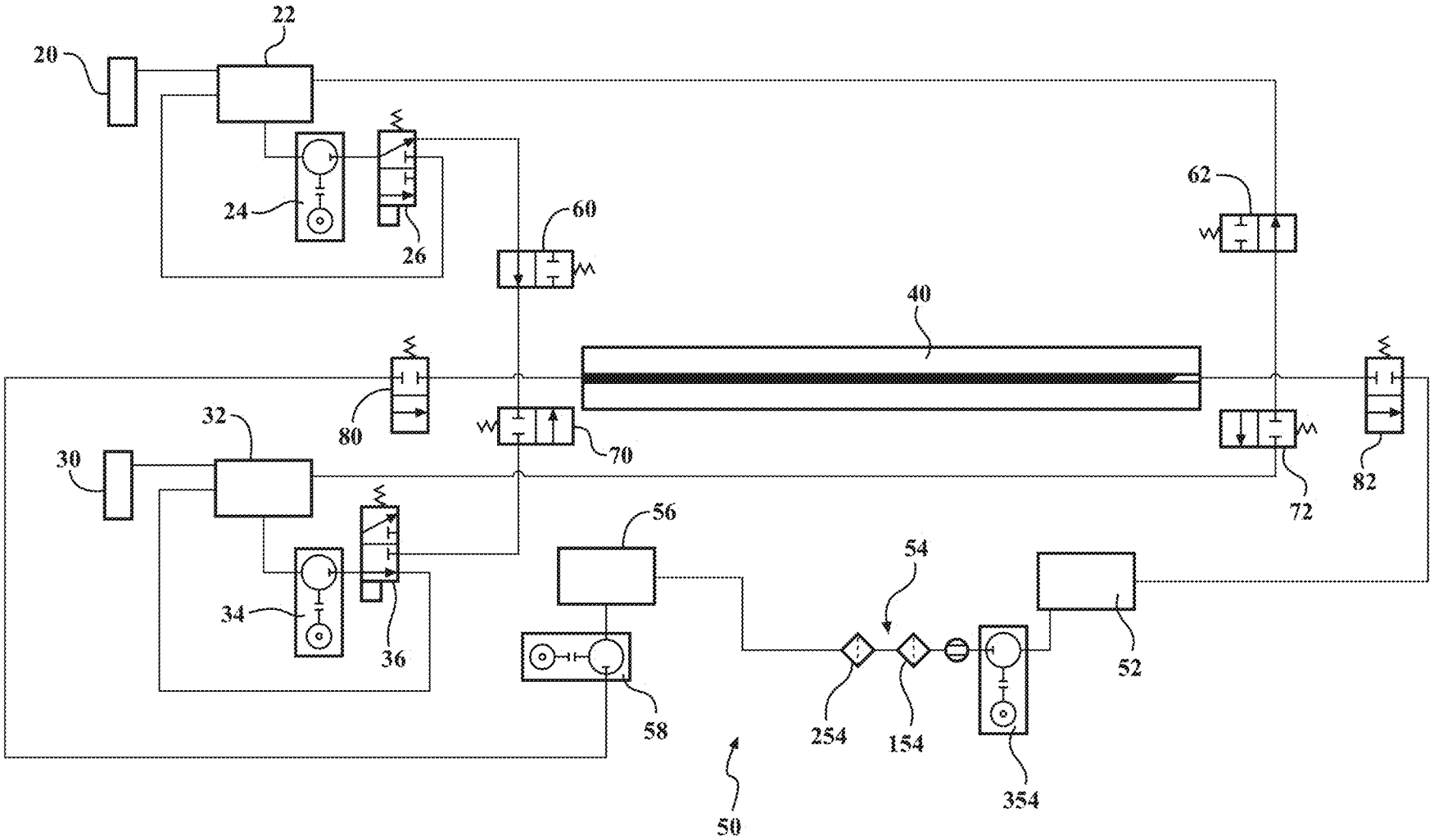
FIG. 1A schematically depicts a linear substrate infusion system configured for infusion of a first colored dye, according to one or more aspects described herein.

The following summary is provided to facilitate an understanding of some of the innovative features unique to the present disclosure and is not intended to be a full description. A full appreciation of the various aspects of the disclosure can be gained by taking the entire specification, claims, drawings, and abstract as a whole.

Provided are new methods and systems that address the need for imparting desirable characteristics to a linear substrate either preformed or as a final or near final step of a formation process. The systems provide for rapid and robust addition of molecules that can provide color, ability to withstand weathering, or other desirable characteristic to a linear substrate. The systems and methods can be practiced on the fly with very rapid infusion of active agents to the linear substrate providing increased throughput and rapid manufacturing of linear substrates which can be tailored and adjusted on demand.

It is a first object of the disclosure to provide methods of forming an active agent infused linear material that includes passing a substantially linear polymeric substrate through a linear substrate infusion chamber in a first direction, flowing a liquid infusion solution through the linear substrate infusion chamber in a second direction, and contacting the linear substrate with the liquid infusion solution at an infusion temperature and for an infusion time effective to infuse the one or more active molecules into or onto a surface of the linear substrate, thereby forming an active agent infused linear material. In aspects, the liquid infusion solution includes one or more active molecules. In aspects, the second direction is substantially opposite or substantially parallel to the first direction.

It is another object of this disclosure to provide a linear substrate infusion apparatus or system for the rapid manufacture or modification of a linear substrate. A system may include a dye supply supplying a dye, a process tank connected to the dye supply and providing a reservoir of a liquid infusion solution including the dye through the linear substrate infusion system, and a process chamber fluidly connected to the process tank for contacting the liquid infusion solution with a linear substrate effective to infuse the dye into or onto a surface of the linear substrate. In some aspects, the process chamber includes a processing barrel including an infusion solution inlet, an infusion solution outlet, a linear substrate inlet optionally coincident with the infusion solution outlet, and a linear substrate outlet positioned at an opposing end of the processing barrel from the linear substrate inlet and coincident with the infusion solution inlet.

It is another object of this disclosure to provide a polymeric linear substrate includes one or more polymeric materials optionally present as an outer layer, the one or more polymeric materials infused with one or more active agents to form an infused surface. In aspects, the infused surface has a depth of infused active agent of less than 100 micrometers. In aspects, the polymeric linear substrate has a diameter or other maximum cross sectional dimension (exclusive of length) of at least 500 micrometers.

DETAILED DESCRIPTION

As described herein, various aspects of linear substrate infusion systems are disclosed with features or structures that promote infusion of an active agent into the substrate or a coating or layer on the substrate. The methods and systems are optionally used with preformed substrates that are subjected to the methods with the substrate at ambient temperature. The systems provided are useful for infusion of color or anti-weathering agent(s), as two examples, into polymeric materials made from or otherwise including thermoset plastics or thermoplastics. The processes and systems disclosed herein are particularly suitable for imparting desired characteristics to linear polymeric substrates.

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, "a first element," "component," "region," "layer," or "section" discussed below could be termed a second (or other) element, component, region, layer, or section without departing from the teachings herein.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

Unless otherwise defined, all terms (including technical and scientific terms) used herein have the same meaning as commonly understood by one of ordinary skill in the art to which this disclosure or relevant portion thereof belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

The description is primarily directed to the infusion of one or more active molecules such as colored dye(s) or others into a polymeric material forming or as a part of a linear substrate. Any linear substrate is suitable for use such as hollow, solid, or multilayer linear substrates. Such is presented for illustrative and descriptive purposes alone. The disclosure is equally applicable to any linear substrate that includes a polymeric surface material, sometimes referred to herein as "linear polymeric substrates," such as but not limited to hose or other hollow tubing, solid linear substrates, multicomponent or multilayer linear substrates, sheeting or films of an elongated nature, among other items recognized in the art. A linear substrate may be continuous for a length that is optionally of 10 feet or longer, optionally of 100 feet or longer, optionally of 1000 feet or longer, optionally of 10,000 feet or longer. The processes and systems provided herein may be used to infuse an active material into a linear substrate that is not limited by length. A continuous linear substrate optionally has a length that is greater than 1000 times or more the maximal cross sectional dimension of the linear substrate. The diameter or other maximal cross section linear dimension of a linear substrate optionally does not exceed 10 cm, optionally 2 cm, optionally 1 cm, optionally 0.5 cm, optionally 0.1 cm, optionally 0.01 cm. The diameter or maximal cross sectional linear dimension (excluding length) of a linear substrate or polymeric material layer thereon is optionally greater than 50 μm, optionally greater than 500 μm, optionally greater than 0.1 cm, optionally greater than 0.2 cm, optionally greater than 1 cm. Accordingly, the diameter or other maximal cross section linear dimension of a linear substrate may be optionally from 500 μm to 10 cm, optionally from 0.1 cm to 2 cm, optionally from 0.2 cm to 1 cm, or optionally within any range within the values recited herein.

While much of the specification is directed to imparting color into a linear polymeric substrate, it is appreciated that molecules other than dyes are equally able to be effectively infused into the surface of the linear polymeric substrate to impart other desired characteristic(s) such as but not limited to anti-weathering illustratively but not limited to imparting UV or other light protection, anti-static, lubricity, among others. As such, a "dye" as used herein is equally represented by other molecules that impart one or more other desirable physical or chemical characteristics to the final product and may or may not impart a color or color change to the final product.

In one example, a process for infusing a linear polymeric substrate is provided. A process can include infusing a linear polymeric substrate that can be used for any of a number of purposes such as for conducting, transmitting, or transporting a fluid, electrical energy, light energy, or other. A process employs a solvent system for infusing one or more desired active molecules into the surface of a polymer to thereby create an infused surface that has the desired characteristic such as color or other. In one specific example, the infused material could be a dye or other pigment. In one example, the linear polymeric substrate can be a hose with a typical uncolored outer surface. The hose may have one or multiple polymer coatings consisting of one or multiple polymers. In one example, the hose can be white, gray or other background color as is produced or desired to be produced prior to infusion with the desired active.

In some aspects, the infusion of one or more actives can be achieved either directly after formation of a final shape of a linear substrate, optionally immediately off an extruder, or can be employed on previously manufactured source substrate material. For example, after the formation of a polymer in the desired linear configuration (e.g. hollow, solid, coating a core, such as in the case of a wire, or other), the linear substrate could be immediately infused using the processes and systems discussed herein or previously manufactured substrate could be infused using the processes and systems discussed herein. In particular aspects, color is infused into pre-manufactured substrate, optionally on an as-needed basis. In other aspects, color is infused into material within moments (e.g. less than 1 minute) following extrusion.

A linear substrate optionally includes an outer layer that includes one or more polymeric materials suitable to be infused with an active agent, optionally a dye or other pigment. Exemplary polymeric materials include thermoplastics or thermoset plastics. More specific illustrative examples of a polymeric material include one or more of polypropylene (PP), polyethylene terephthalate (PET), polybutylene terephthalate (PBT), polycarbonates (PC), polyethylene (PE), cross-linked polyethylene (PEX), polylactic acid (PLA), PET copolymers, acrylics, polyethylene naphthalate (PEN), polyamides, polycarbonate co-polymers, polyvinyl chloride (PVC), elastomeric polymers, urethanes, acrylic co-polymers (including but not limited to ethylene (meth) acrylic acid co-polymers, such as those commercially available under the tradename Surlyn™ from DuPont), acrylonitrile butadiene styrene (ABS), or other plastics. In particular aspects, the polymeric material is a polyamide or polycarbonate. In some particular aspects, the polymeric material is or includes a polyamide.

Processes of coloring a linear substrate having at least an outer layer of one or more polymeric materials, optionally a thermoplastic, includes forming a dye infused linear polymeric substrate optionally by: providing a polymeric material in the form of a linear substrate; mixing, immersing, coating or otherwise contacting the polymeric material with an infusion agent solution at an infusion temperature optionally below the melting temperature of the polymeric material and for an infusion time, the infusion agent solution including one or more dye and/or other active materials and, optionally, one or more infusion agents, the one or more dye and/or other active materials optionally imparting a color change to the polymer relative to a like polymeric material that is not infused with the one or more active materials, the one or more infusion agents operable to promote penetration of the active material into the surface of the polymeric material; and infusing the active material into the polymer material by said mixing, immersing, or coating step thereby forming a dye infused linear polymeric substrate.

An infusion temperature is optionally below the glass transition temperature (Tg) of the polymeric material of the linear substrate, optionally below the melting temperature of the polymeric material. In some aspects, the infusion temperature is above the Tg. Optionally, the infusion temperature is at or above the Tg and below the melting temperature. In some aspects, an infusion temperature is from 60 degrees Celsius to 98 degrees Celsius, optionally 81 degrees Celsius to 91 degrees Celsius. In some aspects, an infusion temperature is from 60 degrees Celsius to 99.9 degrees Celsius, optionally 90 degrees Celsius to 99 degrees Celsius. Optionally, an infusion temperature does not exceed 100 degrees Celsius. Optionally, an infusion temperature does not exceed 99 degrees Celsius.

A linear substrate is infused for an infusion time. An infusion time is optionally 1 minute or less, optionally at or between 0.01 second to 1 minute. A polymer used in the processes optionally is or includes: a polyamide such as nylon; a polyester, optionally polyethylene terephthalate; polyvinylchloride; or polycarbonate. The active material following infusion optionally penetrates the polymer to a depth of less than 2 millimeters, optionally to less than 1 millimeter. In some aspects, an active material is infused to a final depth of less than 200 microns. In any of the aspects, an active material is optionally a dye such as optionally an azo or quinone dye, or combinations thereof. In some aspects, the polymer is preheated to the infusion temperature prior to contact with an infusion solution and/or dye material. Optionally, the infusion solution and/or dye material is heated to the infusion temperature and an unheated polymer is immersed, mixed, or otherwise contacted with the infusion solution.

In some aspects, a polymeric material is contacted with an infusion solution including one or more infusion agents. An infusion agent is a chemical composition operable to promote penetration of a barrier material into the surface of a polymeric material. An infusion solution is optionally an aqueous solution, or a solution of one or more organic solvents or solutes. An infusion solution is optionally entirely formed of an infusion agent and an active material. In some aspects, an infusion solution includes water, an infusion agent, and optionally one or more additives. In some aspects, the infusion solution includes water. In some aspects, the water is tap water. An additive is illustratively one more surfactants or emulsifiers, as will be discussed in greater detail below. An infusion solution optionally includes one or more dyes or other active material. For example, in some aspects, the infusion solution consists essentially of a dye and water. As another example, in some aspects, the infusion solution consists essentially of a dye, water, and acetic acid solvent. As yet another example, in some aspects, the infusion solution consists essentially of a dye, water, and a glycol. In any of these aspects, the water may be tap water. In some aspects, the infusion solution is a liquid infusion solution.

In some aspects, an active material is suitable to impart color or a change in color to the linear substrate. In some aspects, the active material is a dye. The dye used to form a colored linear polymer according to particular aspects is optionally a stable dye or an unstable dye. In some aspects, a dye is an unstable dye, optionally an unstable acid dye. Optionally, an acid dye is, however, a stable acid dye. An "unstable dye" as defined herein is a dye that is chemically or structurally alterable by exposure to heat, light energy, or both, when the dye is not bound to a substrate. Several such dyes are known in the art. An unstable dye optionally includes azo type dyes or unstabilized quinone dyes.

Optionally, a dye is a static dye. As used herein, the term "static dye" means a dye that does not substantially change color upon exposure to (or being shielded from) ultraviolet (UV) light when the dye is not bound to a substrate.

In some aspects, a dye is an acid dye. An acid dye is optionally an anthraquinone acid dye, an azo acid dye, a triphenylmethane acid dye or a premetalized acid dye. Illustrative examples of acid dyes include Acid Blue #60, Acid Blue #260 (Blue RL) Acid Red #151 ((5Z)-5-[(2-methoxy-5-methyl-4-sulfonatopheny)hydrazinylidene]-6-oxonaphthalene-2-sulfonate), Acid Red #407 (i.e., Rubine S3G), Acid Red #1 (i.e., Acid Red G; azophloxine), Acid Black #2, Acid Yellow #23, Acid Yellow #43 (i.e., Yellow R), Acid Orange #144 (i.e., Orange SR 125%) and Acid Violet #17 (i.e., 3-[[4-[[4-(diethylamino)phenyl]-4-[ethyl-[(3-sulfonatophenyl)methyl]azaniumylidene]cyclohexa-2,5-dien-1-ylidene]methyl]-N-ehtylanilino]methyl]benzene-sulfonate).

Static dyes that may be included in a colored polymeric material include, for example, fabric dyes and disperse dyes as well as dyes that are known in the art as being suitable for tinting plastic articles, such as thermoplastic PVC or polyamide articles. Examples of suitable disperse dyes include, but are not limited to, Disperse Blue #3, Disperse Blue #14, Disperse Yellow #3, Disperse Red #13, Disperse Violet #1, Solvent Yellow #3, Solvent Black #3, and Disperse Red #17. The classification and designation of the static dyes are recited herein in accordance with "The Colour Index", 3$^{rd}$ edition published jointly by the Society of Dyes and Colors and the American Association of Textile Chemists and Colorists (1971). The term static dye as used herein optionally includes mixtures of static dyes.

Illustrative examples of static dyes include the water-insoluble azo, diphenylamine and anthraquinone compounds. Illustrative examples include acetate dyes, dispersed acetate dyes, dispersion dyes and dispersol dyes, such as are disclosed in Colour Index, 3$^{rd}$ edition, vol. 2, The Society of Dyers and Colourists, 1971, pp. 2479 and pp. 2187-2743, respectively. Specific examples of dispersal dyes include Solvent Blue 59 (9,10-Anthracenedione, 1,4-bis(ethylamino)-), Solvent Red 111 (9,10-Anthracenedione, 1-(methylamino)-), Solvent Yellow 160:1 (3-(5-Chloro-2-benzoxazolyl)-7-(diethylamino)-2H-1-benzopyran-2-one), Disperse Orange 47 (1H-Indole-5-carboxylicacid,2-[2-(1,5-dihydro-3-methyl-5-oxo-1-phenyl-4H-pyrazol-4-ylidene) ethylidene]-2,3-dihydro-1,3,3-trimethyl-methyl ester), Disperse Yellow 3 (Acetamide, N-[4-[2-(2-hydroxy-5-methylphenyl)diazenyl]phenyl]-), Solvent Violet 26 (1,4-Diamino-2,3-diphenoxyanthraquinone), Disperse Red 1 (i.e., Scarlet CSB; 4-[(2-Hydroxyethyl)ethylamino]-4'-nitroazobenzene), Disperse Violet 1 (1,4-diamino-9,10-dihydroanthracene-9,10-dione), Solvent Yellow 3 (2-methyl-4-[2-(2-methylphenyl)diazen-1-yl]aniline), Solvent Yellow 93 (i.e., Yellow 3G; 4-((1,5-dihydro-3-methyl-5-oxo-1-phenyl-4H-pyrazol-4 ylidene)methyl)-2,4-dihydro-5-methyl-2-phenyl-3H-pyrazol-3-one); Disperse Green 9 (i.e., Green C6B; N-[5-diethylamino)-2-[(3,5-dinitro-2-thienyl)azo]phenyl] acetamide), Disperse Blue 14 (i.e., Subliprint Blue 700141; 1,4-bis(methylamino)anthraquinone); and Solvent Black 3 (2,2-dimethyl-6-{2-[4-(2-phenyldiazen-1-yl)naphthalen-1-yl]diazen-1-yl}-2,3-dihydro-1H-perimidine). Other dyes are illustratively those additional dyes found in U.S. Pat. No. 7,175,675 and references cited therein.

A colored or other polymeric material is optionally formed by employing infusion techniques from any of several processes. In some aspects, a dye infused linear polymeric material is formed by employing infusing techniques as described in U.S. Pat. Nos. 6,733,543; 6,749,646; 6,929,666; 6,949,127; 6,994,735; 7,094,263; 7,175,675; 7,504,054; 7,921,680; or 8,206,463. In some aspects, a dye infused linear polymeric material is formed by employing infusing techniques as described in: U.S. Patent Application Publication Nos.: 2008/0067124; 2009/0297829; 2009/0297830; or 2009/0089942.

An infusion agent is optionally an oxidizing agent, a free radical precursor, or a compound having the formula of Formula I:

$$R^1—[(O(CH_2)_m)_n—]OR^2 \quad (I)$$

wherein $R^2$ and $R^1$ are each independently H or a $C_{1-18}$ alkyl, benzyl, benzoyl, or phenyl; n is 1, 2 or 3; and m is any value from 1 to 35. In some aspects, m is 1 to 12. In some aspects, m is 1. Optionally, $R^1$ denotes H. Optionally, $R^1$ denotes butyl and $R^2$ denotes H. An aromatic $R^1$ or $R^2$ group of Formula I is optionally substituted with 1 to 5 groups selected from halo groups (e.g., chloro, bromo and fluoro), linear or branched $C_1$-$C_9$ alkyl groups (e.g., methyl, ethyl, propyl, butyl, pentyl, hexyl, heptyl, octyl and nonyl), and aromatic groups (e.g., phenyl).

Specific examples of an infusion agent according to Formula I include 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, 2-(2-ethoxyethoxy)ethanol, 2-(2-butoxyethoxy)ethanol, dimethoxyethane, diethoxyethane, and dibutoxyethane, ethylene glycol butyl ether, diethylene glycol ethylether, diethylene glycol butylether, propylene glycol propylether, dipropylene glycol propyl ether and tripropylene glycol propylether, or combinations thereof.

The infusion agent is typically present in the infusion solution in an amount of less than or equal to 50 percent by weight, optionally less than or equal to 30 percent by weight, optionally less than or equal to 25 percent by weight, optionally less than or equal to 20 percent by weight. The infusion agent is optionally present in the solution in an amount of at least 10 percent by weight, optionally at least 15 percent by weight, optionally at least 17 percent by weight. The infusion agent may be present in the infusion solution in an amount ranging from 10 to 30 percent by weight or any value or range therebetween. For example, the infusion agent is optionally present in the infusion solution in an amount from 10 to 30 percent by weight, optionally from 15 to 25 percent by weight, optionally in an amount of from 17 to 20 percent by weight. The percent weights being based on the total weight of the infusion solution.

An infusion solution optionally includes one or more infusion agents. Optionally, an infusion solution includes 1, 2, 3, 4, 5, 6, or more infusion agents. In some aspects, when more than one infusion agent is present in an infusion solution, there may be infusion agents of more than one type. In some aspects, a first infusion agent is an agent of Formula I, and a second infusion agent is a diol of Formula II:

$$H—[(O(CH_2)_m)_n—]OH \quad (II)$$

wherein n is 1, 2 or 3; and m is any value from 1 to 35. In some aspects, m is 1 to 12. In some aspects, m is any value from 2 to 4. Optionally, m is any value from 2 to 4 and n is 1, 2, or 3. Illustrative agents of Formula II include diethylene glycol, triethylene glycol and 1,4 butanediol.

An infusion agent is optionally present in an infusion agent solution at a concentration of 2.5 to 20, optionally 5 to 12.5, optionally 7.5 to 10 parts by weight (pbw). A second infusion agent is optionally present in an amount identical to a first infusion agent. Optionally, a second infusion agent is present in an amount of 5 to 30, optionally 10 to 25, optionally 15 to 20 pbw.

An infusion solution optionally includes one or more emulsifiers. Illustrative examples of an emulsifier include ionic or non-ionic emulsifiers, or mixtures thereof. Illustrative examples of an anionic emulsifier include: amine salts or alkali salts of carboxylic, sulfamic or phosphoric acids, for example, sodium lauryl sulfate, ammonium lauryl sulfate, lignosulfonic acid salts, ethylene diamine tetra acetic acid (EDTA) sodium salts, and acid salts of amines, such as, laurylamine hydrochloride or poly(oxy-1,2-ethanediyl), α-sulfo-omega-hydroxy ether with phenol 1-(methylphenyl) ethyl derivative ammonium salts. An emulsifier is optionally an amphoteric emulsifier illustratively: lauryl sulfobetaine; dihydroxy ethylalkyl betaine; amido betaine based on coconut acids; disodium N-lauryl amino propionate; or the sodium salts of dicarboxylic acid coconut derivatives. Typical non-ionic emulsifiers include ethoxylated or propoxylated alkyl or aryl phenolic compounds, such as octylphenoxypolyethyleneoxyethanol. A specific emulsifier used is diethylene glycol.

An emulsifier is optionally present in an infusion agent solution in an amount from 0 to 15 weight percent, optionally 7 to 15 weight percent, optionally 10 to 15 weight percent, optionally 0.5 to 5 weight percent, optionally 3 to 4 weight percent.

An infusion solution optionally includes one or more surfactants.

An infusion solution optionally includes one or more salts. It was unexpectedly discovered that the inclusion of salt improves the infusion of active agent, optionally dye into or onto a substrate. Particular improvements are observed with salt concentrations of 0.1 to 0.5 g/L. A salt concentration is optionally greater than 0.1 g/L and less than 0.5 g/L. Optionally a salt concentration is 0.1 g/L to 0.3 g/L. A salt concentration is optionally 0.1 g/L, 0.2 g/L, 0.3 g/L, 0.4 g/L, or 0.5 g/L. A salt is optionally a sodium salt, potassium salt, or other. In some aspects a salt is optionally a salt of Na, K, Ca, Mg, or combinations thereof.

In some aspects, the infusion solution consists or consists essentially of water and a dye selected from the group consisting of Acid Red 407, Acid Blue 260, Acid Orange 144, Acid Red 1, Acid Yellow 43, Disperse Blue 14, Disperse Green 9, Solvent Yellow 93, or Disperse Red 1.

An infusion solution is optionally at ambient temperature (approximately 25° C.) or heated above ambient temperature. In some aspects, an infusion process includes heating a linear polymeric material alone or in the presence of an infusion solution where heating is to a temperature below the melting temperature of the polymeric material. Optionally, an infusion solution is preheated or heated in the presence of a linear substrate, optionally to any infusion temperature less than 100° C.

The systems described herein may be used to impart color or other desired physical or chemical characteristic into a linear polymeric substrate by a process that may include infusing a linear substrate at an infusion temperature. The infusion temperature is optionally below the melting temperature of the linear substrate polymeric material. An infusion temperature is the temperature of the polymeric material during the infusion process. In some aspects, an infusion temperature is at or above the glass transition temperature (Tg) or the polymeric material to be infused. Optionally, an infusion temperature is at or above the Tg and below the melting temperature. For amorphous thermoplastic materials without true melting points, an infusion temperature is optionally above the Tg but is not so high that the article shape is affected. Optionally, an infusion temperature is between 81° C. and 91° C. Illustratively, for a polyamide thermoplastic material an infusion temperature may be 90° C. to 99° C. Illustratively, for a PVC thermoplastic material an infusion temperature may be 75° C. to 90° C. It is appreciated that polymers that may have a lower heat distortion temperature may be infused at a lower temperature. As one example, an infusion temperature of a polyurethane may be about 60° C. As another example, the infusion temperature may be from 90° C. to 98° C.

The linear substrate is optionally formed by immersing a linear polymeric material in an infusion solution for an infusion time where the immersing is done in an element of an infusion system as provided herein. In some aspects, it is appreciated that spraying an infusion solution onto the linear substrate is excluded. An infusion time is optionally any time from <1 second to 120 minutes, or more. In some aspects, an infusion time is optionally from <1 second to 30 minutes, optionally from <1 second to 20 minutes, optionally from 1 second to 10 minutes, optionally from 1 second to 1 minute, optionally from 5 seconds to 1 minute, optionally from 5 seconds to 30 seconds, optionally from 10 seconds to 20 seconds, optionally 2 to 10 seconds, optionally 3 to 6 seconds. An infusion time is optionally 1, 2, 3, 4, 5, 6, 7, 8, 9, 10, 15, 20, 25, 30, 35, 40, 45, 50, 55 or 60 milliseconds. An infusion time is optionally 1, 2, 3, 4, 5, 6, 7, 8, 9, 10, 15, 20, 25, or 30 seconds. In some aspects, an infusion time is less than one min, optionally from 0.01 second to 1 minute, or any value or range therebetween. In some aspects, an infusion time is from 0.1 seconds to 5 seconds or from 0.25 seconds to 3 seconds.

In some aspects, the infusion time is sufficient to enable the active molecules to penetrate the surface of the linear polymeric material to a depth of less than 1 millimeter. In some aspects, the infusion time is sufficient to enable the active molecules to penetrate the surface of the linear polymeric material to a depth of less than 200 microns. Accordingly, in some aspects, the active molecules penetrate the surface of the linear polymeric material from 1 micron to 1 millimeter, from 5 microns to 500 microns, from 10 microns to 250 microns, or from 20 microns to 200 microns.

The following provides exemplary description of a linear substrate infusion system suitable for infusing an active agent (e.g., dye) into the surface a linear substrate. It is appreciated that one or more of the colored dyes as the active in an infusion solution used in the following description are substitutable with one or more other active agents to be infused into the linear substrate. Throughout this disclosure the infusion system is referenced as having a first colored dye and a second colored dye appreciating that colored dye is equally substitutable with another active agent to be infused into the linear substrate. Limitation of discussion to two colored dyes is for ease of discussion and simplicity. It will be appreciated that aspects of the infusing system may include 3 or more colored dyes by replicating one or more elements of the associated systems of the first or second colored dye for each additional colored dye added to the infusion system.

Figure 1B:
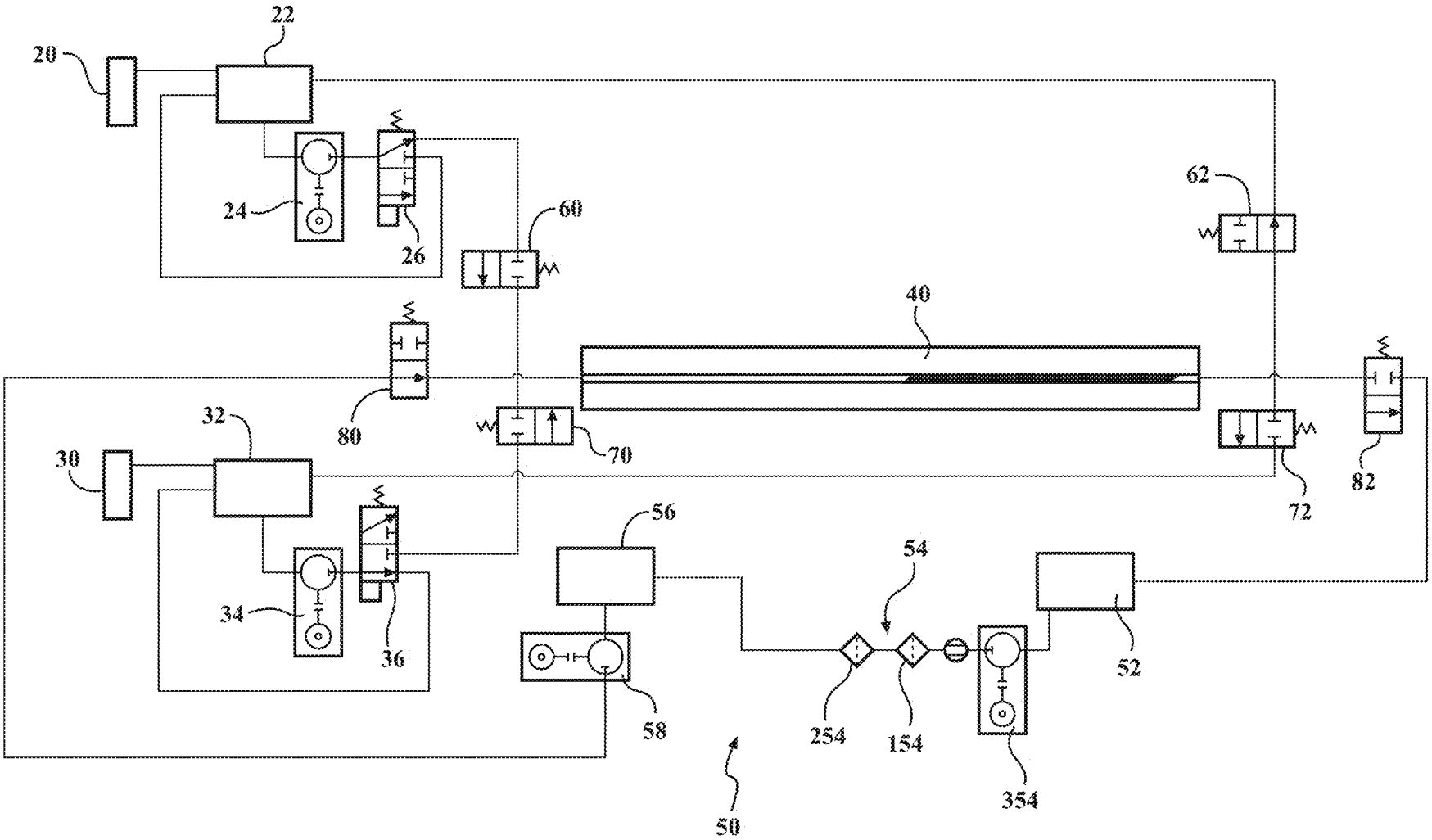
FIG. 1B schematically depicts a linear substrate infusion system configured for change over from a first colored dye to a second colored dye, according to one or more aspects described herein.
Figure 1C:
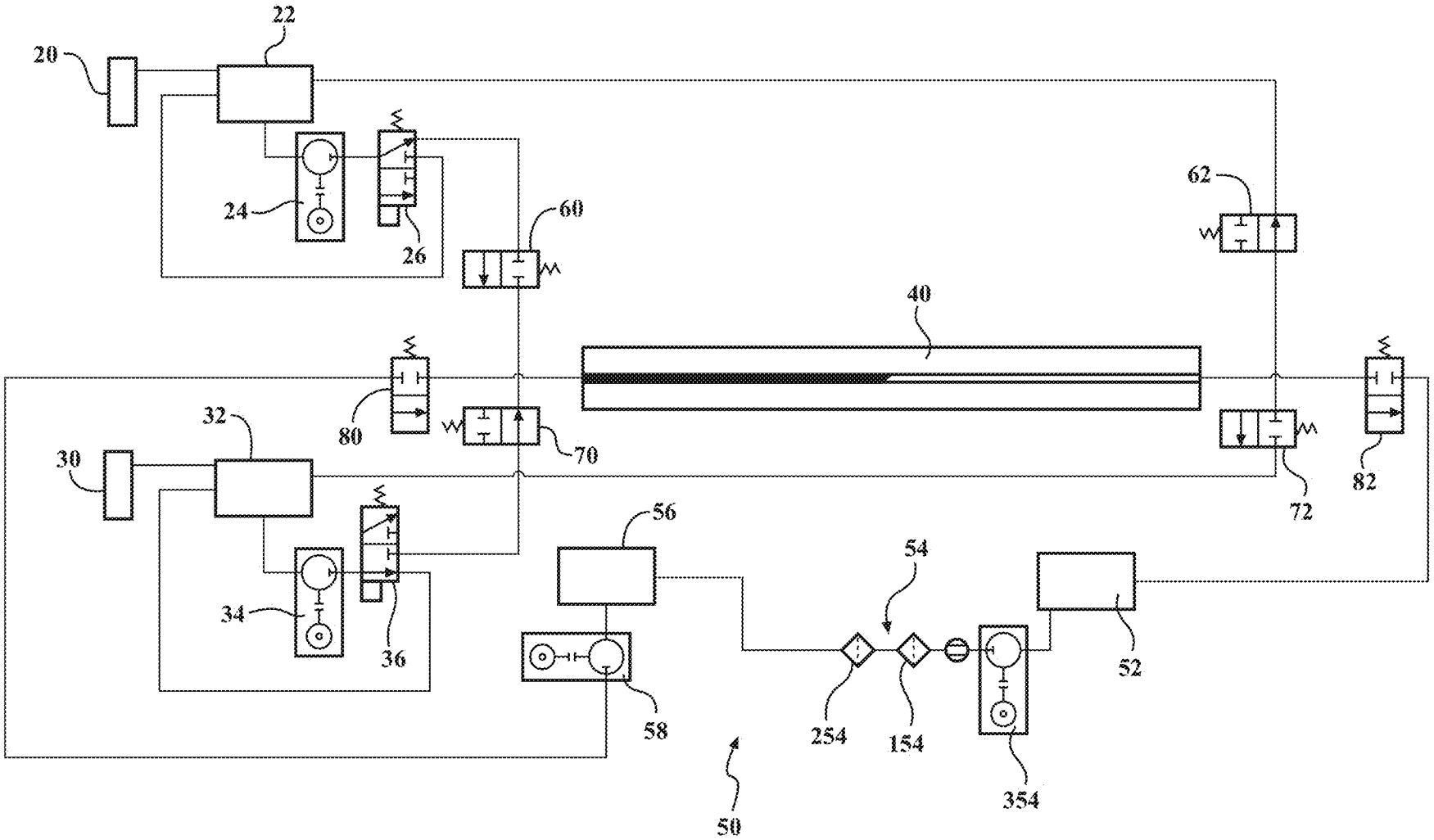
FIG. 1C schematically depicts a linear substrate infusion system configured for infusion of a second colored dye, according to one or more aspects described herein.

FIGS. 1A, 1B, and 1C illustrate a schematic layout of the interconnectivity of the infusion system. A generalized infusion system configured for two infusion solution options includes a first dye supply 20 for providing an infusion solution and a second dye supply 30 for providing a second infusion solution. The first dye supply 20 and second dye supply 30 are attached to a first process tank 22 and a second process tank 32 respectively. The process tanks 22, 32 each provide a reservoir of infusion solution for circulation through the infusion system. The first process tank 22 and the second process tank 32 each are fluidly connected to a process chamber 40. The process chamber 40 contacts the desired infusion solution with the substrate to color the outer surface of the substrate by infusing the active material (e.g., the dye) into the substrate surface. Upon exiting the process chamber 40 the infusion solution is returned to the first process tank 22 or the second process tank 32 for the respective color from which the colored dye originated. Propulsion of the first infusion solution and the second infusion solution is provided by a first dye pump 24 and a second dye pump 34 respectively. A process tank is optionally formed of one or more non-reactive materials, optionally stainless steel. A non-reactive material is one that will not cause degradation of an infusion solution or any component therein or the linear substrate during an infusion time.

The infusion system is unique in providing the ability to change the active material that is infused into the linear substrate during processing of the linear substrate. Specifically, in one example, the infusion system may be converted from creating blue substrate to creating green substrate while the system is operating. There is no requirement to terminate the infusion system operation, clean the equipment, and re-feed the substrate into the equipment when a change of active is desired. A single run of substrate, from a pre-manufactured spool (or other source) or as the output of a substrate forming line, may have the color changed from red to green, for example, without stopping the processing line. For example, change of one active or active combination to another active or active combination is achievable in 30 seconds to 2 minutes such that the scrap material produced during the changeover is minimized.

In one or more aspects, the first process tank 22 and the second process tank 32 are each connected to respective heating loops. The heating loops raise the temperature of the first infusion solution and the second infusion solution to the desired set point for introduction to the process chamber 40 and coloring of the linear substrate. Each heating loop may comprise an in-line heater to raise the temperature of the first infusion solution or the second infusion solution respectively during passage of the first infusion solution or the second infusion solution through the heating loop. A heating loop is optionally 1 to 10 feet long, optionally 2 to 4 feet long. It is appreciated that the length of the heating loop need only be sufficient to heat the infusion solution or portion thereof to a desired temperature.

In one or more aspects, the first process tank 22 and the second process tank 32 may be heated tanks. In further aspects, the first process tank 22 and the second process tank 32 may each comprise an agitator or mixer to maintain a uniform temperature and mixture throughout the infusion solvent within the first process tank 22 or the second process tank 32. In example, a process chamber has a length of 7 feet and an internal diameter of 1.5 inches producing a system with a fluid capacity of 0.65 gallons. The dimensions of the process chamber are for exemplary purposes alone, and other dimensions are contemplated.

In further aspects, a filter may be included in the heating loop and/or between the heating loop and process chamber 40 and/or between the process chamber 40 and the process tank 22, 32. When included, the filter serves to filter and remove sediment or unwanted particles that enter the infusion solvent during the coloring operation. An illustration of a filter includes standard bag filters such as Trade Size 3, 316 stainless steel, top feed.

The heating loop allows circulation of the infusion solvent when not being provided to the process chamber 40. The heating loop for the first infusion solution includes a first diverter valve 26 and the heating loop for the second infusion solution includes a second diverter valve 36. The first diverter valve 26 and the second diverter valve 36 direct the respective infusion solution on a recirculation pathway in the heating loop when in a first position and direct the infusion solution away from the heating loop to the process chamber 40 when in a second position. Although various aspects described herein include two process tanks and two heating loops, it is contemplated that a greater or fewer number of process tanks and respective heating loops may be included, depending on the particular embodiment.

Referring to FIGS. 1A, 1B, and 1C which illustrate a schematic layout of a generalized infusion system, the infusion system further comprises a solvent loop 50. The solvent loop 50 is fluidly connected to the process chamber 40. The solvent loop 50 provides clean solvent (e.g., without an active material, such as a dye) to flush the process chamber 40 when changing from one infusion solution to a different infusion solution. Flushing the process chamber 40 prevents improper coloration of the linear substrate and contamination of the actives in the first process tank 22 and the second process tank 32. Optionally, the second infusion solution is used to flush the first infusion solution from the process chamber without a clean solvent flush, which may increase the speed of infusion solution turnover. The solvent loop 50 optionally includes a solvent recovery tank 52, a filter system 54, a clean solvent tank 56, and at least one supply pump 58.

The solvent recovery tank 52 is fluidly connected to an outlet of the process chamber 40. Infusion solvent, having passed through the process chamber 40, is recovered in the solvent recovery tank 52 for further processing and cleaning. In one exemplary aspect, a solvent recovery tank is formed of a nonreactive material such as stainless steel. A solvent recovery tank 52 has a volume sufficient to recover a needed amount of infusion solvent, optionally 60 gallons. Such a solvent recovery tank optionally has a shape that is cylindrical, conical or combinations thereof.

The filter system 54, as a subcomponent of the solvent loop 50, removes contaminants from the spent infusion solvent in the solvent recovery tank 52. In one or more aspects, the filter system 54 comprises a bag filter 154 and a carbon filter 254 fluidly connected to the solvent recovery tank 52. The bag filter 154 functions to remove solid or particulate materials from the spent solvent. Similarly, the carbon filter 254 functions to remove dissolved active material from the spent infusion solvent. The filter system 54 may also include a filter pump 354 to provide a head pressure for transit of the spent solvent through the bag filter 154 and/or carbon filter 254.

Passage of the spent infusion solvent through the filter system 54 returns the infusion solvent to a clean state. The cleaned infusion solvent is conveyed to the clean solvent tank 56 which is fluidly connected to the filter system 54. The clean solvent tank 56 serves as a reservoir of infusion solvent to be provided to the process chamber 40 during transitions from one active material(s) to a different active material(s). A clean solvent tank is optionally made of a nonreactive material, optionally stainless steel, and is of a size suitable to hole a desired amount of infusion solvent. In example, a clean solvent tank is a 60 gallon tank of stainless steel of a shape that is cylindrical, conical, or combination thereof.

In some aspects, infusion solvent is subjected to a cleaning or modification step. A cleaning or modification step may be achieved through the use of a carbon filter, distillation system, other system, or combinations thereof. Modification of a system may be that a dye, or other additive, is intended such that an initial dye or other active agent may be substituted with a subsequent dye or other active agent. In some aspects, the dye and optional other active agents are separated from the other components of the infusion solvent (e.g., the water, acid, carrier, diol, or optional surfactants). Such a separation is environmentally favorable in that it allows for re-use of the non-dye components of the bath, for example with another dye or dyes, or with a fresh dye(s), or as a rinse composition for rinsing dyed plastic articles removed from the dye bath. In addition, the dye separation method may be performed if the dye of the dye bath has been damaged, such as oxidized or otherwise denatured (e.g., due to over heating due to a temperature spike).

The dye separation process may be performed by contacting the dye bath with particulate activated carbon, flowing the infusion solvent into a distillation chamber, and then isolating desired materials or components therefrom. The desired components may then be reused as desired. The infusion solvent, in some aspect, may be contacted with the activated carbon by passing the infusion solvent continuously through a bed or column optionally containing activated carbon.

The clean solvent tank 56 is fluidly connected to an inlet of the process chamber 40. To convey the clean solvent from the clean solvent tank 56 to the process chamber 40, at least one supply pump 58 is provided. The supply pump 58 provides motive force to convey the solvent to the process chamber 40, through the process chamber 40, and to the solvent recovery tank 52. A supply pump has sufficient power to move infusion solvent throughout the system or portion thereof. Optionally, a pump of 0.5 horsepower with a flow rate of up to 25 gallons per minute (gpm) is sufficient. In some aspects, the flow rate is set to 1-2 gpm.

Further, the solvent loop 50 may include a solvent heater to raise the temperature of the infusion solvent to the desired set point for introduction to the process chamber 40. In one or more aspects, an in-line heater is provided between the clean solvent tank 56 and the process chamber 40 to heat the infusion solvent in an on-demand fashion. In further aspects, a submerged heater is provided within the clean solvent tank 56 to heat and hold the bulk clean solvent within the clean solvent tank 56. In some aspects, an in-line solvent heater is used, optionally with a power of 8 kW to 15 kW.

Figure 2:
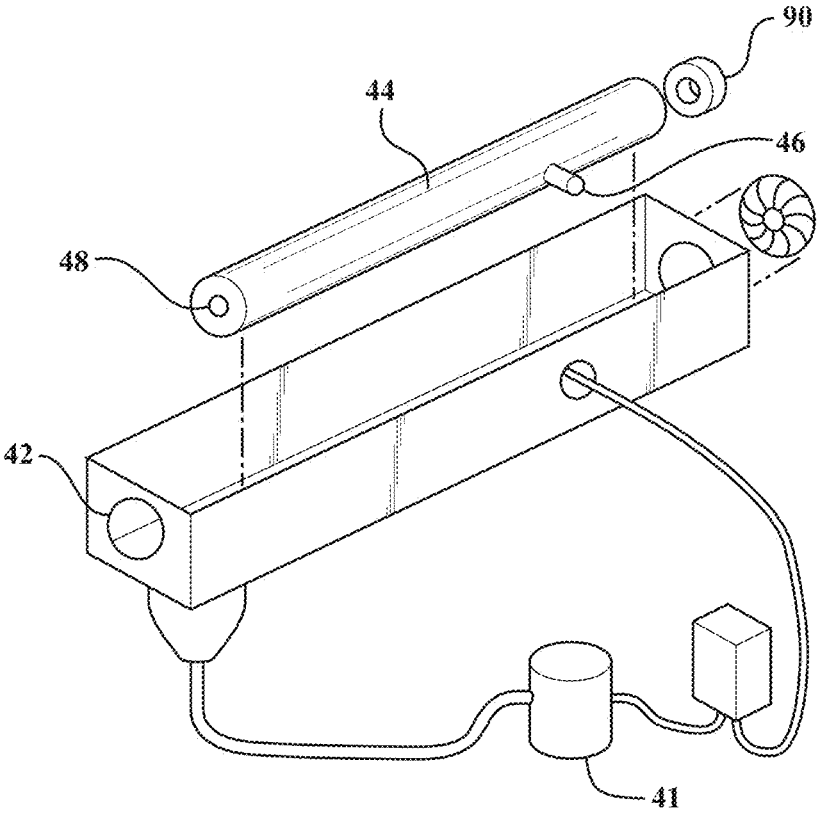
FIG. 2 illustrates a linear substrate infusion system, according to one or more aspects described herein.
Figure 3:
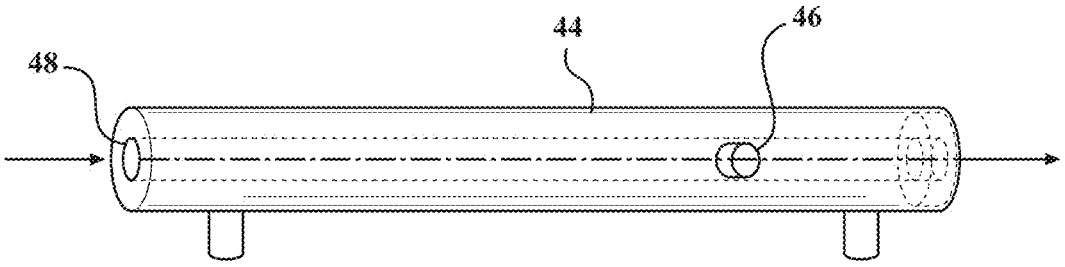
FIG. 3 illustrates a side view of a processing barrel according to an exemplary aspect.

With reference to FIGS. 2 and 3, an aspect of the process chamber 40 is illustrated for a single color system. The process chamber 40 includes a catch basin 42 and a processing barrel 44. The catch basin 42 includes a drain in fluid communication with an infusion solution reservoir (first process tank 22, second process tank 32). The processing barrel 44 is formed by machining a form into the final configuration and includes an infusion solution inlet 46 and an infusion solution outlet 48 as well as a linear substrate inlet 47 coincident with the infusion solution outlet 48 and a linear substrate outlet 49 positioned at the opposite end of the processing barrel 44 from the linear substrate inlet 47. The processing barrel 44 optionally forms a hollow tube configuration to allow passage of a linear substrate to be infused in a first direction through the processing barrel 44 and an infusion solution flowing within the processing barrel 44 optionally in a second counterflow direction opposite the direction of the movement of the linear substrate. The infusion solution optionally flows within the processing barrel 44 in a second counterflow direction parallel to the direction of the movement of the linear substrate. The colored dye reservoir 41 is in fluid communication with the infusion solution inlet 46 on the processing barrel 44 and feeds infusion solution to the processing barrel 44 and more specifically to the hollow center of the processing barrel 44. In some aspects, the processing barrel 44 is 7 feet in length and the infusion solution inlet 46 is positioned 5 feet from the infusion solution outlet 48. This arrangement positions the infusion solution inlet 46 approximately 2 feet from the linear substrate outlet in this exemplary aspect. The processing barrel 44 is optionally positioned with a tilt to allow the infusion solution to drain by gravity. In an aspect, the processing barrel 44 is positioned at an approximately 3° angle with the infusion solution outlet 48 lower than the infusion solution inlet 46. In operation, infusion solution is provided to the infusion solution inlet 46 while the linear substrate is passed through the processing barrel 44 from the linear substrate inlet to the linear substrate outlet. Gravity results in the infusion solution flowing toward the chemical outlet 48 and draining into the catch basin 42 for recycling back to the reservoir. In some aspects, infusion solution is dragged upstream toward the linear substrate outlet by the counterflow travel of the linear substrate such that the infusion solution may also drain from the linear substrate outlet of the processing barrel 44.

In some aspects, the processing chamber 44 is formed of two halves separated lengthwise with each half machined from aluminum with a substantially semicircular channel therein such that when the two halves are associated a chamber is formed for infusion of the linear substrate. The first half and the second half are optionally associated by a hinge or other suitable fastener to allow removable association of the first half and the second half. The finished diameter of the resulting chamber has a diameter of 1.5 inches or other desired size, with the size suitable to house the linear substrate within the diameter.

Referring once again to FIGS. 1A, 1B, and 1C, the infusion system includes a plurality of valves to control the flow of the first infusion solution from the first process tank 22, the second infusion solution from the second process tank 32, and the flow of solvent from the clean solvent tank 56 to the process chamber 40 as well as away from the process chamber 40 to their respective reservoirs (the first process tank 22, the second process tank 32, and the solvent recovery tank 52). Specifically, a first infusion solution inlet valve 60 controls flow of the first infusion solution from the first process tank 22 to the process chamber 40 and a first infusion solution outlet valve 62 controls flow of the first infusion solution from the process chamber 40 back to the first process tank 22. Similarly, a second infusion solution inlet valve 70 controls flow of the second infusion solution from the second process tank 32 to the process chamber 40 and a second infusion solution outlet valve 72 controls flow of the second infusion solution from the process chamber 40 back to the second process tank 32. Finally, a solvent inlet valve 80 controls flow of the clean solvent from the clean solvent tank 56 to the process chamber 40 and a solvent outlet valve 82 controls flow of the spent solvent from the process chamber 40 to the solvent recovery tank 52. A valve 80 is optionally a standard industrial ball valve of 316 stainless steel. Pneumatic or manual actuation valves may be used, among others.

In operation, the infusion system allows running changes to the color of dye (or other active change) infused into the linear substrate surface. FIG. 1A illustrates an exemplary infusion system and associated valves positioned for application of the first infusion solution to the linear substrate in the process chamber 40. Specifically, the first infusion solution valve 60 and the first infusion solution outlet valve 62 are in an open position whereas the second infusion solution inlet valve 70, the second infusion solution outlet valve 72, the solvent inlet valve 80, and the solvent outlet valve 82 are in all a closed position. In the configuration for application of the first infusion solution to the linear substrate in the process chamber 40 the first infusion solution is provided to the process chamber 40 and returned to the first process tank 22. Within the process chamber 40 the first colored dye contained in the first infusion solution is infused into the surface of the linear substrate.

During application of the first infusion solution to the linear substrate, the heating loop for the second process tank 32 is activated to raise the temperature of the second infusion solution to the desired temperature set point for infusion of the active into the linear substrate. The heating loop is optionally activated in advance of the change from the first infusion solution to the second infusion solution to provide an opportunity to fully heat the second infusion solution and negate the need to cease operation of the infusion system during the infusion solution conversion.

To initiate a change from the first infusion solution to the second infusion solution, the process chamber 40 is optionally flushed with solvent to remove residual of the first infusion solution. FIG. 1B illustrates an exemplary infusion system and associated valves positioned for flushing or otherwise changing the type of infusion solution in the process chamber 40. Specifically, the first infusion solution inlet valve 60 is closed while the first infusion solution outlet valve 62 remains open. Concurrently, the solvent inlet valve 80 is opened to initiate flow of the solvent. The solvent acts to flush the process chamber 40 of the residual first infusion solution. After a timed period, calculated to substantially flush all the residual first infusion solution from the process chamber 40, the first infusion solution outlet valve 62 is closed and the solvent outlet valve 82 is opened. This configuration provides a solvent loop to flush the process chamber 40 of any residual first infusion solution. By adjusting the first infusion solution outlet valve 62 and the solvent outlet valve 82 after the timed period substantially all the residual first infusion solution is returned to the first process tank 22 and a minimal amount is flushed out with the solvent into the solvent recovery tank 52. It is desirable to minimize flow of infusion solution into the solvent recovery tank 52 because the filter system 54 must remove any colored dye or other active material which is collected by the solvent.

FIG. 1C illustrates the infusion system and associated valves positioned for application of the second infusion solution to the linear substrate in the process chamber 40. Upon sufficient flushing of the process chamber 40 with the solvent, the solvent inlet valve 80 is closed while the solvent outlet valve 82 remains open. Concurrently, the second infusion solution inlet valve 70 is opened to initiate flow of the second infusion solution from the second process tank 32. The second infusion solution acts to flush the process chamber 40 of the residual solvent and fully fill the process chamber 40 with the second infusion solution. After a timed period, calculated to flush all the residual solvent from the process chamber 40, the solvent outlet valve 82 is closed and the second infusion solution outlet valve 72 is opened. By adjusting the solvent outlet valve 82 and the second infusion solution outlet valve 72 after the timed period, all the residual solvent is returned to the solvent recovery tank 52 with only a minimal amount flushed out with the solvent into the solvent recovery tank 52.

The infusion system can be provided with various electronic, mechanical, or other controls for controlling or adjusting one or more parameters of the infusion process or the system itself. For example, an interface for operating the system can be provided. The interface may comprise a graphical user interface (GUI) to allow an operator to monitor and/or adjust process parameters. Illustrative examples of process parameters include a) infusion solution temperature in tank, b) infusion solution temperature in process chamber, c) solvent flow rate, d) position of valves (e.g. open, closed, intermediate), e) speed of linear substrate moving through process chamber, f) control pump on/off, g) infusion solution level in process tanks, h) solvent level in solvent recovery tank, i) solvent level in clean solvent tank, j) solvent level in process tanks, k) solvent temperature in recovery tank, l) temperature setting of process tanks (thermocouple), m) linear substrate footage counter, n) color concentrate level meter, among others.

One or more of several temperature, color, infusion level, linear substrate or other sensors are optionally included in the infusion system. Such sensors may be positioned at any desired location such as within the processing chamber, within any supply line or other portion, any tank, or within optical, thermal, or electrical contact with a linear substrate, infusion solution, or other component.

The process of infusing a linear substrate (e.g., a hose as one example of a preformed linear substrate formed of a polymeric material) may include either supplying the linear substrate from a storage reel or other stored form and moving the linear substrate into the infusion system processing chamber in a longitudinal direction. In some aspects, the linear substrate may also be provided as a direct output of the linear substrate manufacturing process such as off an extruder or prior to cooling or storage of the linear substrate. Passage of the linear substrate through the processing chamber can be set at any desired speed so long as the speed is not so great so as to reduce the residence time in the infusion solvent within the processing chamber to a point at which insufficient infusion is achieved. In one example, the speed of the linear substrate moving through the processing chamber can be illustratively set at 50 ft/min to 400 ft/min.

The linear substrate is led to and run directly through the process chamber 40 optionally without contact to any side of the processing chamber such that the infusion solution can fully surround the linear substrate and may uniformly infuse the substrate. The linear substrate is maintained in the process chamber 40 for an infusion time sufficient to ensure that the active material in the infusion solution is infused into the linear substrate to a desired depth, hue, opacity or other characteristic. In one example, the residence time can range from a fraction of a second to many seconds. A residence time is optionally 0.1 second to 5 seconds, optionally 0.1 second to 3 seconds, optionally 0.25 seconds to 1 second, optionally 0.1 second to 0.25 seconds, optionally 0.1 second to 0.5 seconds.

As shown in FIGS. 1A-1C, the first process tank 22 and the second process tank 32 are optionally heated to raise the temperature of the first infusion solution and second infusion solution respectively. In one example, the infusion solution is heated to a temperature of 80° C. to 99.9° C. In another example, the infusion solution can be heated to 90° C. to 99.9° C. Optionally, the infusion solution is heated as close as possible to the boiling temperature of water at 100° C. (1 atm). In one specific example, the infusion solution is heated to approximately 99° C.

The first dye pump 24 and second dye pump 34 pump the first infusion solution from the first process tank 22 and the second infusion solution from the second process tank 32 respectively to the process chamber 40 and back to the first process tank 22 or second process tank 32. The passage of the first infusion solution or the second infusion solution through the process chamber 40 contacts the colored dyes or other active materials in the infusion solution to the linear substrate and results in the dyeing of the linear substrate by infusion of the dye(s) into the surface of the linear substrate. It is also contemplated that the first process tank 22 and the second process tank 32 are connected to the first dye supply 20 and the second dye supply 30 respectively, which are configured to add additional colored dye as needed to the first and second process tanks 22, 32. However, other methods of colored dye addition are also contemplated.

Once the linear substrate exits the process chamber 40, the linear substrate can then be transferred to one or more washing stations to remove excess infusion solution.

EXAMPLES

It is believed that the various aspects described hereinabove will be further clarified by the following examples.

Example 1

Three samples 8 gauge THHN wires covered in polyvinyl chloride (PVC) insulation with a nylon jacket were exposed to one of the example dye infusion solutions for five seconds and rinsed with water after the bath. Each of the dye infusion solutions included the dye at a concentration of 2 g/L and water at 98° C. Each dye infusion solution included one of four acid dyes (Acid Blue RL, Acid Red 407, Acid Orange SR, or Acid Yellow R) and one of three types of water (Toledo City Water (sink or tap water), Reverse Osmosis (RO) water, or distilled (DI) water).

Following infusion, L*a*b* values were obtained for each sample, and the average for the three samples was taken. A ΔE was calculated as compared to undyed material, which had L*a*b* values of (100, 0, 0) in the CIELAB color space. The results are reported in FIG. 4.

Figure 4:
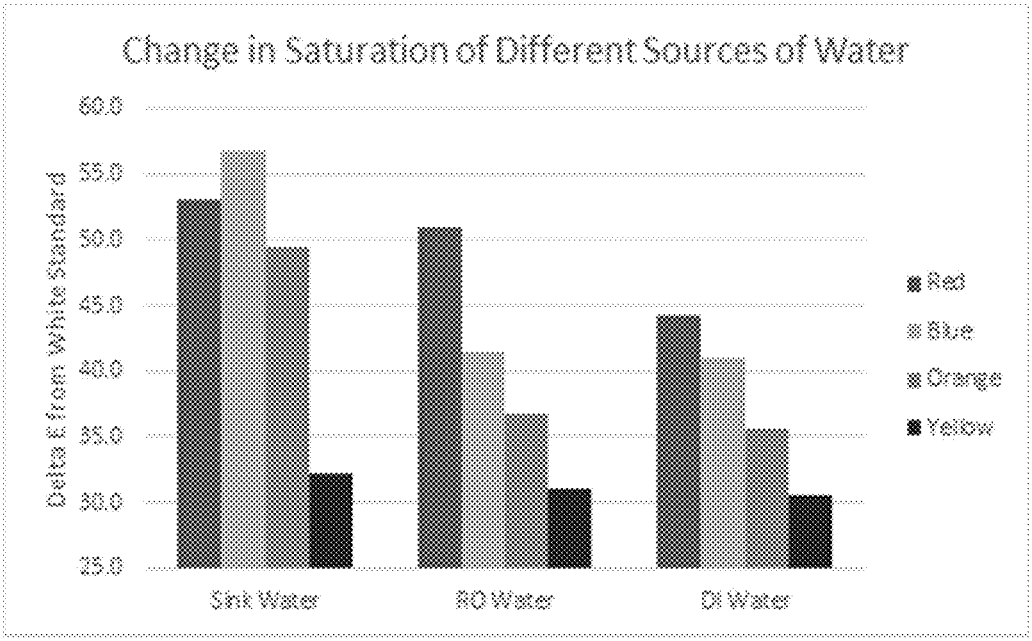
FIG. 4 graphically depicts an average ΔE (y-axis) for wires infused with infusion solutions including one of four acid dyes and sink water, RO water, or DI water (x-axis), according to one or more aspects described herein.

As shown in FIG. 4, the ΔE for each acid dye was increased in tap water as compared to both RO water and DI water. Moreover, the ΔE for each acid dye was greater in RO water than DI water.

Example 2

Based on the results of Example 1, further experimentation was conducted to determine whether the addition of sodium chloride would affect the infusion of acid dyes in nylon. In this Example, the amount of total dissolved solids (TDS) was measured for various infusion solutions. The TDS in parts per million (ppm) or parts per thousand (ppt) for each tested solution is reported in Table 1.

TABLE 1

Total Dissolved Solids for Infusion Solutions

| | DI water | Sink water |
|---|---|---|
| Cold | 5.01 ppm | 149.7 ppm |
| Heated | 5.63 ppm | 175.0 ppm |
| Heated w/Acid Red 407 dye | 144.1 ppm | 238.2 ppm |
| After 0.1 g/L added | 597.7 ppm | |
| After 0.2 g/L added | 1.167 ppt | |
| After 0.5 g/L added | 2.73 ppt | |

Acid Red 407 dye was added at 2 g/L to the heated (98° C.) DI water, heated (98° C.) DI water with 0.1 g/L salt, heated (98° C.) DI water with 0.2 g/L salt, and heated (98° C.) DI water with 0.5 g/L salt.

The samples 8 gauge THHN wires covered in polyvinyl chloride (PVC) insulation with a nylon jacket were exposed to one of the example dye infusion solutions for five seconds and rinsed with water after the bath. Following infusion, L*a*b* values were obtained for each sample. A ΔE was calculated as compared to the undyed material, which had L*a*b* values of (100, 0, 0) in the CIELAB color space. The results are reported in FIG. 5.

Figure 5:
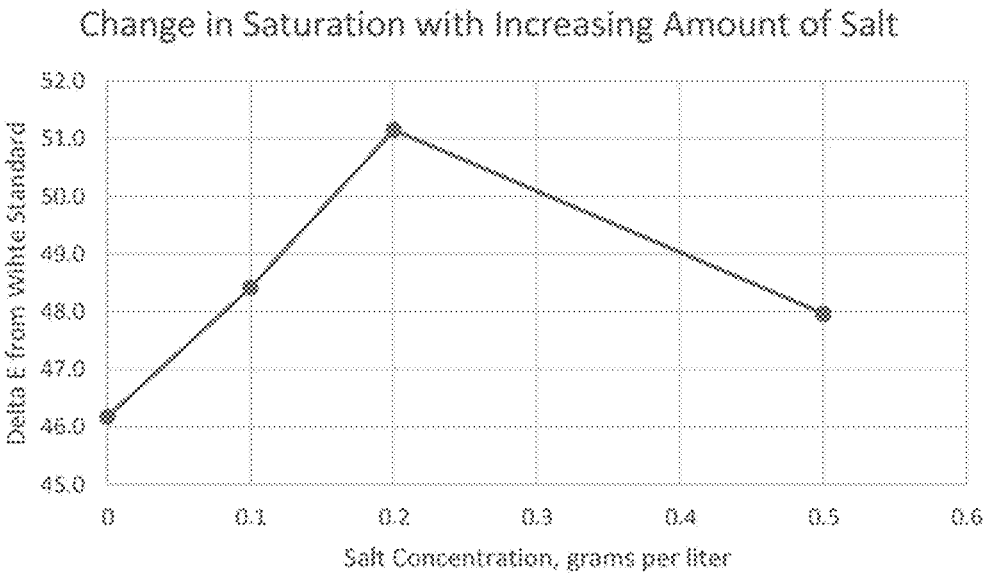
FIG. 5 graphically depicts an average ΔE (y-axis) for wires infused with infusion solutions including an acid dye and DI water including a varying amount of added salt (x-axis), according to one or more aspects described herein.

As shown in FIG. 5, the ΔE for increased for salt concentrations from 0 to about 0.2 g/L, but then decreased with additional salt.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

The present description above and in the accompanying drawings are with reference to a variety of examples. The purpose served by the disclosure, however, is to provide examples of the various features and concepts, not to limit the scope of the invention. One skilled in the relevant art will recognize that numerous variations and modifications may be made to the examples described above without departing from the scope of the present invention.

While particular aspects have been illustrated and described herein, it should be understood that various other changes and modifications may be made without departing from the spirit and scope of the described subject matter. Moreover, although various aspects have been described herein, such aspects need not be utilized in combination.

Embodiments can be described with reference to the following clauses, with preferred features laid out in dependent clauses:

1. A method of forming an active agent infused linear material comprising: passing a substantially linear polymeric substrate through a linear substrate infusion chamber in a first direction; flowing a liquid infusion solution comprising one or more active molecules through the linear substrate infusion chamber in a second direction, the second direction being substantially opposite or substantially parallel the first direction; and contacting the linear substrate with the liquid infusion solution at an infusion temperature and for an infusion time effective to infuse the one or more active molecules into or onto a surface of the linear substrate thereby forming an active agent infused linear material.

2. The method of clause 1, wherein the one or more active molecules impart one or more of UV protection, anti-static, or lubricity to the linear substrate.

3. The method of any preceding clause, wherein the linear substrate comprises at least one polymer selected from the group consisting of a polyamide, a polyester, polyvinylchloride, or polycarbonate.

4. The method of any preceding clause, wherein the infusion temperature is below a glass transition temperature of the polymer.

5. The method of any of clauses 1-4, wherein the infusion temperature is above a glass transition temperature of the polymer.

6. The method of any preceding clause, wherein the infusion temperature is below a melting temperature of the polymer.

7. The method of any preceding clause, wherein the infusion temperature is from 90° C. to 98° C.

8. The method of any preceding clause, wherein the infusion time is from 0.1 seconds to 5 seconds.

9. The method of any preceding clause, wherein the infusion time is from 0.25 seconds to 3 seconds.

10. The method of any preceding clause, wherein the active molecules penetrate the surface of the linear substrate to a depth of less than 1 millimeter.

11. The method of any preceding clause, wherein the active molecules penetrate the surface of the linear substrate to a depth of less than 200 micrometers.

12. The method of any preceding clause, further comprising heating the liquid infusion solution to the infusion temperature.

13. The method of any preceding clause, wherein the linear substrate is unheated during the contacting step.

14. The method of any preceding clause, wherein the one or more active molecules comprise an unstable dye.

15. The method of any preceding clause, wherein the one or more active molecules comprise an acid dye.

16. The method of any preceding clause, wherein the liquid infusion solution consists essentially of the one or more active molecules.

17. The method of clause 16, wherein the one or more active molecules is an acid dye.

18. The method of any preceding clause, wherein the liquid infusion solution consists essentially of the one or more active molecules and an infusion agent consisting essentially of water.

19. The method of clause 18, wherein the one or more active molecules is an acid dye.

20. The method of any of clauses 1-17, wherein the liquid infusion solution consists essentially of an acid dye, water, and a solubilizing agent that is optionally glycol.

21. The method of any one of clauses 1-17, wherein the liquid infusion solution consists essentially of an acid dye, water, glycol, and an acid.

22. The method of clause 21 wherein the acid is acetic acid.

23. The method of any preceding clause, wherein the active molecule is one of Acid blue 260/Blue RL/, Rubine S3G/Acid Red 407, Yellow R/Acid Yellow 42, or Orange SR/Acid Orange 144.

24. The method of clause 20 wherein the acid dye is one of Acid blue 260/Blue RL/, Rubine S3G/Acid Red 407, Yellow R/Acid Yellow 42, or Orange SR/Acid Orange 144.

25. The method of clause 21 wherein the acid dye is one of Acid blue 260/Blue RL/, Rubine S3G/Acid Red 407, Yellow R/Acid Yellow 42, or Orange SR/Acid Orange 144.

26. The method of clause 22 wherein the acid dye is one of Acid blue 260/Blue RL/, Rubino, S3G/Acid Red 407, Yellow R/Acid Yellow 42, or Orange SR/Acid Orange 144.

27. The method of any of clauses 1-15, wherein the active molecule comprises an anthraquinone dye.

28. The method of any of clauses 1-15, wherein the active molecule comprises an azo dye.

29. The method of any of clauses 1-15, wherein the active molecule comprises a triphenylmethane dye.

30. The method of any of clauses 1-15, wherein the active molecule comprises a premetalized dye.

31. The method of any of clauses 1-15, wherein the liquid infusion solution further comprises water.

32. The method of clause 31, wherein the water comprises tap water.

33. The method of clause 31, wherein the water comprises deionized water including from about 0.1 g/L to about 0.5 g/L salt added thereto.

34. A linear substrate infusion system comprising: a dye supply providing a dye; a process tank connected to the dye supply and providing a reservoir of a liquid infusion solution including the dye through the linear substrate infusion system; and a process chamber fluidly connected to the process tank for contacting the liquid infusion solution with a linear substrate effective to infuse the dye into a surface of the linear substrate, the process chamber comprising: a processing barrel comprising an infusion solution inlet, an infusion solution outlet, a linear substrate inlet optionally coincident with the infusion solution outlet, and a linear substrate outlet positioned at an opposing end of the processing barrel from the linear substrate inlet and coincident with the infusion solution inlet.

35. The linear substrate infusion system of clause 34, further comprising a heater connected to the process tank to raise a temperature of the liquid infusion solution to an infusion temperature.

36. The linear substrate infusion system of clause 34 or 35, further comprising a solvent loop connected to the process chamber and providing clean solvent to flush the process chamber.

37. The linear substrate infusion system of any one of clauses 34-36, wherein the dye comprises a non-amine stable solvent dye.

38. The linear substrate infusion system of clause 37, wherein the liquid infusion solution consists essentially of the non-amine stable solvent dye, water and acetic acid.

39. The linear substrate infusion system of any one of clauses 34-36, wherein the dye comprises an acid dye.

40. The linear substrate infusion system of clause 39, wherein the liquid infusion solution comprises glycol.

41. The linear substrate infusion system of clause 39, wherein the liquid infusion solution consists essentially of the acid dye and a solution of water, glycol, and optionally an acid.

42. The linear substrate infusion system of clause 39, wherein the liquid infusion solution consists essentially of the acid dye and water.

43. The linear substrate infusion system of any of clauses 39-42, wherein the acid dye is one of Acid blue 260/Blue RL/, Rubino S3G/Acid Red 407, Yellow R/Acid Yellow 42, or Orange SR/Acid Orange 144.

44. The linear substrate infusion system of any of clauses 39-42, wherein the acid dye comprises an anthraquinone dye.

45. The linear substrate infusion system of any of clauses 39-42, wherein the acid dye comprises an azo dye.

46. The linear substrate infusion system of any of clauses 39-42, wherein the acid dye comprises a triphenylmethane dye.

47. The linear substrate infusion system of any of clauses 39-42, wherein the acid dye comprises a premetalized dye.

48. The linear substrate infusion system of any of clauses 36-44, wherein the liquid infusion solution further comprises water.

49. The linear substrate infusion system of clause 48, wherein the water comprises tap water.

50. The linear substrate infusion system of clause 48, wherein the water comprises deionized water including from about 0.1 g/L to about 0.5 g/L salt added thereto.

51. A polymeric linear substrate comprising: an outer layer comprising one or more polymeric materials infused with one or more dyes to form an infused surface, wherein the infused surface has a depth of less than 100 micrometers and wherein the polymeric linear substrate has a cross-sectional diameter of at least 500 micrometers.

52. The polymeric linear substrate of clause 51, wherein the cross-sectional diameter does not exceed 2 cm.

53. The polymeric linear substrate of clause 51 or clause 52, wherein the cross-sectional diameter does not exceed 0.5 cm.

54. The polymeric linear substrate of any of clauses 51-53, wherein the cross-sectional diameter that does not exceed 0.1 cm.

55. The polymeric linear substrate of any of clauses 51-54, wherein the one or more polymeric materials comprise a polyamide, a polyester, polyvinylchloride, or polycarbonate.

56. The polymeric linear substrate of any of clauses 51-55, wherein the one or more polymeric materials include a nylon.

57. The polymeric linear substrate of any of clauses 51-55, wherein the one or more dyes comprise a non-amine stable solvent dye.

58. The polymeric linear substrate of any of clauses 51-55, wherein the one or more dyes comprise an acid dye.

59. The polymeric linear substrate of clause 58, wherein the acid dye is one of Acid blue 260/Blue RL, Rubine S3G/Acid Red 407, Yellow R/Acid Yellow 42, or Orange SR/Acid Orange 144.

It is to be understood that the presently disclosed inventive concepts are not limited in application to the details of construction and/or the arrangement of the components set forth in the previous description or illustrated in the drawings. The presently disclosed inventive concepts are capable of other aspects, or of being practiced or carried out in various ways. Also, it is to be understood that the phraseology and terminology employed herein is for purpose of description and should not be regarded as limiting.

Patents and publications mentioned in the specification are indicative of the levels of those skilled in the art to which the invention pertains. These patents and publications are incorporated herein by reference to the same extent as if each individual application or publication was specifically and individually incorporated herein by reference.

The invention claimed is:

1. A method of forming an active agent infused linear material comprising:

passing a linear polymeric substrate through a linear substrate infusion chamber in a first direction;

flowing a liquid infusion solution comprising one or more active molecules through the linear substrate infusion chamber in a second direction, the second direction being opposite or parallel the first direction; and contacting the linear substrate with the liquid infusion solution such that the portion of the substrate that contacts the infusion solution is immersed in the infusion solution and at an infusion temperature and for an infusion time effective to infuse the one or more active molecules into or onto a surface of the linear substrate at a depth less than the cross sectional dimension of the linear substrate thereby forming an active agent infused linear material.

2. The method of claim 1, wherein the linear substrate comprises at least one polymer selected from the group consisting of a polyamide, a polyester, polyvinylchloride, or polycarbonate.

3. The method of claim 2, wherein the infusion temperature is below a glass transition temperature of the polymer.

4. The method of claim 2, wherein the infusion temperature is from 80° C. to 99.9° C.

5. The method of claim 1, wherein the infusion time is from 0.1 seconds to 5 seconds.

6. The method of claim 1, wherein the active molecules penetrate the surface of the linear substrate to a depth of less than 1 millimeter.

7. The method of claim 1, wherein the one or more active molecules comprise a dye selected from the group consisting of an unstable dye, an acid dye, an anthraquinone dye, an azo dye, a triphenylmethane dye, and a premetalized dye.

8. The method of claim 1, wherein the liquid infusion solution consists essentially of the one or more active molecules and an infusion agent consisting essentially of water.

9. The method of claim 1, wherein the liquid infusion solution consists essentially of an acid dye, water, glycol, and an acid.

10. The method of claim 9, wherein the acid is acetic acid.

11. The method of claim 1, wherein the liquid infusion solution further comprises water, the water comprising tap water, or deionized water including from about 0.1 g/L to about 0.5 g/L salt added thereto.

* * * * *